United States Patent [19]

Petersen et al.

[11] Patent Number: 4,727,843

[45] Date of Patent: Mar. 1, 1988

[54] MOUNTING RETAINER FOR ELECTROMAGNETIC FUEL INJECTOR

[75] Inventors: Tim K. Petersen, Clarkston; Ronald J. Frawley, Utica, both of Mich.

[73] Assignee: General Motors Corporation, Detroit, Mich.

[21] Appl. No.: 427,665

[22] Filed: Sep. 29, 1982

[51] Int. Cl.[4] ..... F02M 61/14

[52] U.S. Cl. ..... 123/470

[58] Field of Search ..... 123/470, 471, 468, 469

[56] References Cited

U.S. PATENT DOCUMENTS

| | | | |
|---|---|---|---|
| 2,777,431 | 1/1957 | Meurer | 123/470 |
| 3,941,109 | 3/1976 | Schmid | 123/470 |
| 4,201,172 | 5/1980 | Jaggle et al. | 123/470 |

FOREIGN PATENT DOCUMENTS

| | | | |
|---|---|---|---|
| 2208646 | 8/1973 | Fed. Rep. of Germany | 123/470 |
| 2439593 | 2/1976 | Fed. Rep. of Germany | 123/470 |
| 2824476 | 12/1979 | Fed. Rep. of Germany | 123/470 |
| 687248 | 9/1979 | U.S.S.R. | 123/470 |

*Primary Examiner*—Willis R. Wolfe, Jr.

*Attorney, Agent, or Firm*—Arthur N. Krein

[57] ABSTRACT

A retainer used for securing an electromagnetic fuel injector to the intake manifold of an engine is in the form of a one-piece grommet, molded of resilient material, which is adapted to be fixed to and to overlie an opening in the intake manifold and which is provided with a socket bore adapted to sealingly receive the discharge end portion of the electromagnetic fuel injector.

4 Claims, 4 Drawing Figures

MOUNTING RETAINER FOR ELECTROMAGNETIC FUEL INJECTOR

FIELD OF THE INVENTION

This invention relates to fuel injectors and, in particular, to a mounting retainer for operatively securing such a fuel injector in an opening in the intake manifold of an internal combustion engine.

DESCRIPTION OF PRIOR ART

Various arrangements have been used for securing an electromagnetic fuel injector to the intake manifold of an internal combustion engine. One such arrangement has required the intake manifold to be provided with a tubular stud with an opening therethrough to receive the discharge end of the injector and, in addition, has required the use of a clamp to effect the operative attachment of the injector to the intake manifold. In addition suitable elastic rings, such as seal rings have been used in association with both the tubular stud and with the clamp to effect such retention. An example of such a mounting arrangement for an electromagnetic fuel injector is shown in U.S. Pat. No. 4,327,690, entitled Fuel Injection Valve, issued May 4, 1982 to Sauer et al.

Alternately, the tubular stud has been formed as a separate element and then secured in a suitable manner to a machined pad provided on the intake manifold. However in all such embodiments, as used in the prior art, plural O-ring seals have been required to effect fluid sealing of the injector and vibration free mounting of the injector.

SUMMARY OF THE INVENTION

The present invention relates to a one-piece retainer, in the form of a grommet of resilient material, that is insertable into an aperture provided in the intake manifold of an engine, the retainer being adapted to receive an electromagnetic fuel injector, or the like, with the retainer thus serving as a seat, seal and insulator for the injector.

Accordingly, a primary object of this invention is to provide a one-piece, grommet type, retainer, of elastomeric material, for use in operatively, sealingly mounting an electromagnetic fuel injector to the intake manifold of an engine.

Still another object of the invention is to provide an improved retainer for securing an electromagnetic fuel injector in operative position on an intake manifold of an engine, the retainer being operative to seat, seal and insulate the injector.

For a better understanding of the invention as well as other objects and further features thereof, reference is had to the following detailed description of the invention to be read in connection with the accompanying drawings.

DESCRIPTION OF A PREFERRED EMBODIMENT

Figure 1:
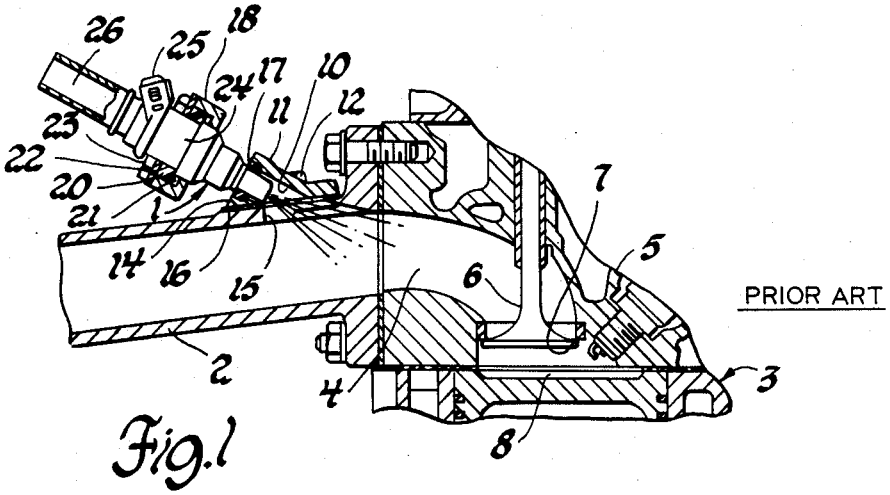
FIG. 1 is a side elevational view, partly in section, of an internal combustion engine showing an exemplary prior art arrangement for securing an electromagnetic fuel injector in operative position to the intake manifold of the engine.

Referring first to FIG. 1, there is shown an exemplary prior art retainer arrangement used to secure an electromagnetic fuel injector 1 to the intake manifold 2 of an engine 3, only part of the engine being shown. As is conventional in a port fuel injection system, the discharge end of the electromagnetic fuel injector 1 is located so as to permit the discharge of fuel into the interior of the intake manifold 2, whereby an induction charge of air flowing through this manifold and the injected fuel can then flow via an intake passage 4 in the cylinder head 5 and through the valve 6 controlled inlet port 7 into the associate cylinder 8 of the engine.

As shown, the lower end of the injector 1 is positioned in the bore opening 10 of a tubular stud 11, which can be formed integral with the intake manifold 2 or, as shown, is formed as a separate element which is suitably secured, as by bolts 12, onto a machined pad 14 provided on the intake manifold 2 so as to encircle an opening 15 in the manifold. Since the tubular stud 11 is usually made of metal, such as cast aluminum, a suitable gasket 16, preferably a heat insulating gasket, is sandwiched between the machined pad 14 and the lower surface of the tubular stud 11. As illustrated, the axis of bore opening 10 is inclined, as desired, relative to the central longitudinal axis of the intake manifold 2 to provide for the desired spray angle relative to the intake port 7.

A suitable sealing ring, such as O-ring 17, is sealingly sandwiched between the lower reduced diameter external body portion of the injector 1 and the internal bore wall of the tubular stud 11 defining the opening 10.

A tubular clamp 18, which may be formed as a separate element or, as shown, formed integral with the tubular stud 11, is used to further effect retention of the injector 1 on the intake manifold 2. Thus in the construction shown, the clamp 18 is formed integral with the tubular stud 11, as by being formed as a cast aluminum injector retainer unit, with a pair of side support ribs, not shown, connecting the clamp 18 to the tubular stud 11.

The clamp 18, in the embodiment illustrated is constructed so as to encircle and grip intermediate, enlarged diameter exterior housing portion of the injector 1 via an elastic ring 20 that is retained in the stepped bore 21 of the clamp 18 by means of an injector retainer plate 22 suitably secured as by screws 23 to the clamp 18. With this arrangement shown, the lower end of the elastic ring 20 is positioned to abut against an outer upward facing radial shoulder 24 of the injector 1.

As is conventional for the type injector shown, injector 1 is provided with an electrical connector 25 intermediate its ends and, with a fuel inlet fitting 26 at its upper end which is adapted to be connected to a source of fuel at a suitable supply pressure.

Figure 2:
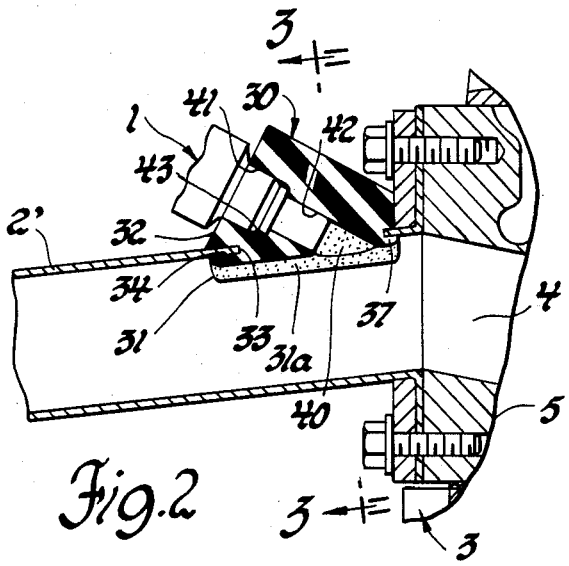
FIG. 2 is a side sectional view of the intake manifold portion of an engine, with the intake manifold having a retainer, in accordance with the invention, operatively associated therewith whereby to retain an electromagnetic fuel injector.
Figure 3:
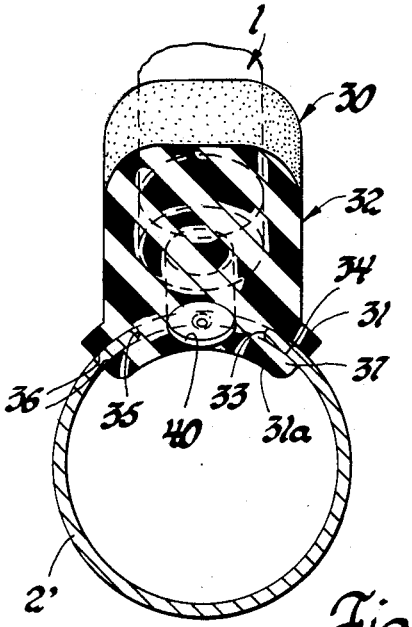
FIG. 3 is a cross sectional view of the intake manifold and retainer of FIG. 2 taken along lines 3—3 of FIG. 2; and, FIG. 4 is a perspective view of the retainer, per se, of FIGS. 2 and 3, with a portion thereof broken away.
Figure 4:
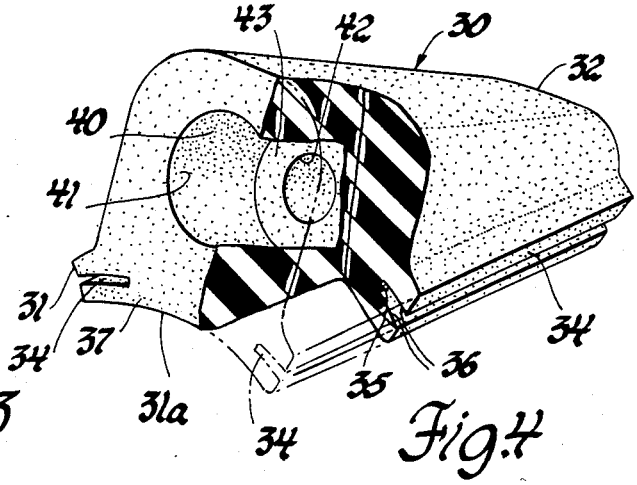

Referring now to the subject matter of the invention, there is shown in FIGS. 2, 3 and 4 an embodiment of a one-piece retainer, generally designated 30, which is adapted to retain, seal and insulate an electromagentic fuel injector 1 in operative position to the intake manifold 2' of an engine.

For this purpose, the retainer 30, in accordance with the invention, is formed as a grommet made of a suitable molded, resilient material, such as Viton rubber, for example of a durometer of 40 to 50, or similar material that is suitable for use in the environment associated with an internal combustion engine. The material should thus provide resistance to gasoline, oil, grease and engine heat while having suitable flexibility to facilitate efficient assembly of the grommet retainer in the opening provided for it in an intake manifold, as described in detail hereinafter. Such a material would thus also be suitable so as to effect sealing engagement with the injector 1 and so as to thermally insulate the injector relative to the intake manifold 2'.

The retainer 30, in the construction illustrated, includes base portion 31 with an inclined boss 32 extending integrally therefrom. The base portion 31 is of a suitable external configuration formed complementary to the shape of an opening 33 provided in the intake manifold 2' and of a size whereby it is adapted to overlie the outer surface of the manifold and cover the opening 33. For this purpose, the base portion 31 is also of an external configuration so as to conform to the exterior configuration of the intake manifold next adjacent to this opening 33.

Thus in the construction illustrated, since the intake manifold 2' is of circular configuration, when viewed in cross section as best seen in FIG. 3, the base portion 31 is accordingly of arcuate or semicylindrical configuration. Thus the bottom surface 31*a* of the base portion 31, in the construction shown, is of semi-circular shape when viewed from an end thereof and, the radius of curvature thereof is less than the radius of the internal wall of the intake manifold 2'.

To effect attachment of the retainer 30 to the intake manifold 2', the base portion 31 thereof is provided with a circumferential extending groove 34 of a size and shape so as to conform substantially to the dimensions of the perimeter of opening 33. Groove 34 is thus formed so as to define a circumferential inboard base 35 and pairs of opposed shoulders 36, the latter being suitably spaced apart whereby they are adapted to sealingly grip opposed surfaces of the intake manifold 2' surrounding the opening 33. In the construction illustrated, the shoulders 36 are of arcuate shape for engagement with the associate inner and outer surfaces of the intake manifold 2'.

Thus in the construction shown, the base portion 31 is of an overall rectangular configuration corresponding to the rectangular shape of opening 33 but this base portion is of a suitable larger size than this opening and, as previously described, when viewed from an end thereof this base portion is of semi-circular configuration. Accordingly, the base 35 of groove 34, which extends around the outer periphery of the base portion 31, is of a size to correspond to the perimeter opening 33 so that when the retainer 30 is positioned as shown in FIGS. 2 and 3, the base 35 will substantially abut against the edges of the intake manifold 2' defining the opening 33 and whereby the opposed shoulders engage the opposed surfaces of the intake manifold around this opening 33.

Preferably as shown, the thickness of the base portion 31 between its lower surface 31*a* and groove 34, which defines a shank portion 37 of the retainer, is preselected to permit sufficient flexing thereof to facilitate assembly of this grommet retainer 30 to the intake manifold 2' through the opening 33.

In the construction shown, the retainer 30 is provided with a stepped through bore 40 that is inclined, as desired relative to the axis of the intake manifold, and which extends through both the boss 32 and base 31 so as to define a socket for the electromagnetic fuel injector 1. This bore 40, with reference to the embodiment illustrated, and starting from the upper surface of boss 32, defines a circular, internal upper and lower walls 41 and 42, respectively, the latter being of reduced internal diameter relative to the inside diameter of the bore wall 41. Walls 41 and 42 are interconnected by an inclined shoulder 43. The internal diameters of walls 41 and 42 are preferably made slightly smaller than the respective corresponding external diameters of the outer housing portions of the injector 1 to be engaged therein whereby the injector is received in this stepped bore 40 by a predetermined press fit.

Thus with this arrangement after the retainer 30 has been secured to the intake manifold 2', as shown, and then thereafter the electromagnetic fuel injector 1 is inserted into the socket bore 40, the interference press fit between the exterior of the injector 1 and the interior bore walls 41 and 42, will cause the material of the retainer to expand radially outward from the injector, that is, radially outward relative to the axis of bore 40, whereby to force the base 35 of groove 34 into further tightened sealed engagement with the edges of the intake manifold 2' defining the opening 33 therein.

The electromagnetic fuel injector 1, as thus mounted in the retainer 30, is supported, sealed and thermally insulated thereby, relative to the intake manifold 2'.

It can thus be appreciated that the grommet type retainer 30 of the invention provides a lower cost advantage over known prior art fuel injector retainers in that it is a one-piece molded retainer which does not require the use of separate O-ring seals to sealingly engage the injector.

The embodiments of the invention in which an exclusive property or privilege is claimed are defined as follows:

1. A retainer for supporting a fuel injector in position for the discharge of fuel from its discharge end portion through a retainer opening in an inlet manifold of an internal combustion engine, said retainer, molded of elastomeric material being in the form of a grommet and including a base portion of a configuration and size so as to overlie the retainer opening in the inlet manifold and; having a circumferential extending groove around its outer peripheral surface whereby it is adapted for mounting in the retainer opening in the inlet manifold; said retainer further including an integral boss extending from one side of said base portion; and, a socket bore extending through said base portion and said boss which is adapted to sealingly receive the discharge end portion of the fuel injector.

2. A retainer for supporting a fuel injector in position for the discharge of fuel from its discharge end portion through a retainer opening in an inlet manifold of an internal combustion engine, said retainer, of elastomeric material including a base portion with a boss upstanding integrally from one side thereof, said base portion being of a configuration corresponding to the configuration of the retainer opening in the inlet manifold and of a size so as to overlie the retainer opening; said base portion having a circumferential extending groove around its outer peripheral surface; said groove defining opposed shoulders adapted to engage opposite surfaces of the intake manifold surrounding the retainer opening therein and in interconnecting base conforming substantially to the configuration of the retainer opening therein in the intake manifold whereby the said groove is adapted to effect mounting of the retainer in the retainer opening in the inlet manifold; and, a socket bore extending through said base portion and said boss which is adapted to sealingly receive the discharge end portion of the fuel injector therein.

3. A retainer for supporting a fuel injector in position for the discharge of fuel from its discharge end portion through a retainer opening in an inlet manifold of an internal combustion engine, said retainer, of elastomeric material, including a base portion with a boss upstanding integrally from one side thereof, said base portion being of a configuration corresponding to the configuration of the retainer opening in the inlet manifold and of a size so as to overlie the retainer opening; said base portion having a circumferential extending groove around its outer peripheral surface for mounting the retainer in the retainer opening of the intake manifold; and, a socket bore extending through said base portion and said boss which is adapted to sealingly receive the discharge end portion of the fuel injector therein, the socket bore being sized whereby, with the fuel injector positioned therein, the material of the base portion will be expanded radially outward therefrom whereby it is adapted to further effect locking engagement of said base portion with the material of the intake manifold around the retainer opening therein.

4. In combination, wall means defining an inlet manifold connectable to an internal combustion engine for supplying an induction charge to at least one inlet port for a cylinder of the engine, said inlet manifold having a retainer opening in the wall means thereof; an injector retainer fixed in said retainer opening in said inlet manifold, said injector retainer of elastomeric material, having a grommet base portion of a size and shape so as to overlie said opening and having an annular groove around its outer peripheral edges for snap fit engagement within said opening and, a boss extending upward from a surface of said grommet base portion; said injector retainer having a socket bore extending through both said boss and said grommet base portion; and, a fuel injector positioned in said socket bore of said injector retainer in sealing engagement therein, said fuel injector being adapted to effect radial outward expansion of said grommet base portion so as to further effect locking engagement of said grommet base portion to said inlet manifold.

* * * * *